US006969062B2

(12) United States Patent
Fasler et al.

(10) Patent No.: US 6,969,062 B2
(45) Date of Patent: Nov. 29, 2005

(54) GUIDE APPARATUS FOR GUIDING SHEETS, AND METHOD OF OPERATING A GUIDE APPARATUS

(75) Inventors: Gaby Fasler, Bruchsal (DE); Markus Möhringer, Weinheim (DE); Jochen Renner, Edingen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 51 days.

(21) Appl. No.: 09/745,563

(22) Filed: Dec. 21, 2000

(65) Prior Publication Data

US 2001/0004144 A1 Jun. 21, 2001

(30) Foreign Application Priority Data

Dec. 21, 1999 (DE) ..... 199 62 116

(51) Int. Cl.[7] ..... B65H 3/24

(52) U.S. Cl. ..... 271/142; 271/226; 271/263; 271/265.04; 271/273

(58) Field of Search ..... 271/226, 262, 271/263, 265.04, 273, 142

(56) References Cited

U.S. PATENT DOCUMENTS 4,369,959 A * 1/1983 Hornbuckle ..... 271/3.1
4,607,837 A * 8/1986 Pierce ..... 271/273
4,746,004 A * 5/1988 Hess et al. ..... 271/245 X
4,753,433 A * 6/1988 Rodi et al. ..... 271/263
4,896,875 A * 1/1990 Gotschewski
5,171,980 A * 12/1992 Marzullo et al. ..... 250/239 X
5,636,961 A * 6/1997 Ohta ..... 414/411
5,975,524 A 11/1999 Döpke et al.
6,164,438 A * 12/2000 VerMehren ..... 271/272 X
6,239,825 B1 * 5/2001 Kuwabara et al. ..... 347/197

FOREIGN PATENT DOCUMENTS

| | | |
|---|---|---|
| DE | 222 197 | 1/1909 |
| DE | 1 089 774 | 9/1960 |
| DE | 25 52 277 | 6/1977 |
| DE | 44 35 264 A1 | 4/1996 |
| DE | 296 15 996 U1 | 12/1996 |

* cited by examiner

*Primary Examiner*—Patrick Mackey
(74) *Attorney, Agent, or Firm*—Laurence A. Greenberg; Werner H. Stemer; Ralph E. Locher

(57) ABSTRACT

A guide apparatus for guiding sheets to a sheet-processing machine, in particular a printing machine, and a method of operating the guide apparatus are described. The guide apparatus has at least one guide element which is disposed above a feed table and whose distance from the feed table can be set with the aid of a height-adjusting device. The guide apparatus is distinguished by the fact that the height-adjusting device has a first drive and a second drive, which can be actuated independently of each other.

20 Claims, 5 Drawing Sheets

GUIDE APPARATUS FOR GUIDING SHEETS, AND METHOD OF OPERATING A GUIDE APPARATUS

BACKGROUND OF THE INVENTION

Field of the Invention

The invention relates to a guide apparatus for guiding sheets to a sheet-processing machine.

Sheet-processing machines are known, such as printing machines in which an underlapped stream of sheets is fed over a feed table to an acceleration system belonging to the machine. In this case, a sheet is drawn off the feed table and accelerated, while the sheet located underneath is being aligned and quietened at front lays or front top lays in the sheet transport and lateral directions. The sheet can be influenced so severely by the sheet running out that, for example, it shoots over the front lays or front top lays and runs with it into the machine. In order to separate this "imbricated formation", that is to say the sheets overlapping each other, a guide apparatus is used such as is disclosed by German Patent DE 296 15 996 U1, for example. The guide apparatus disposed above the feed table deflects the outgoing sheet in such a way that a large separating angle is produced between the feed table and the sheet running out over the front top lay, so that the sheet located underneath is guided reliably under the top lays.

Depending on the printing-material thickness, the printing-material stiffness, the sheet format and the machine speed, the distance between the guide apparatus and the feed table and, in the paper running direction, the front lays or front top lays can be adjusted. The guide apparatus has a stable shaft which is continuous over the feed table and impairs the accessibility of the machine operator to the front lays, for example to remove a misfed sheet or to set the print-free margin. In addition, it has proven to be disadvantageous that it is not possible to ensure the reliable entry of the first sheet of a stream of sheets, in particular in the case of thick printing materials which are very wavy at the sheet leading edge, in all cases to the guide apparatus or, respectively, to the front lays/front top lays.

SUMMARY OF THE INVENTION

It is accordingly an object of the invention to provide a guide apparatus for guiding sheets, and a method of operating a guide apparatus that overcome the above-mentioned disadvantages of the prior art devices and methods of this general type.

With the foregoing and other objects in view there is provided, in accordance with the invention, a guide apparatus for guiding sheets to a sheet-processing machine, including a printing machine. The guide apparatus is formed of a guide element to be disposed above a feed table, and a height-adjusting device connected to the guide element for adjusting a distance between the guide element and the feed table. The height-adjusting device has a first drive and a second drive which can be actuated independently of each other.

The solution contains at least one guide element which is disposed above a feed table and whose distance from the feed table can be set with the aid of a height-adjusting device. The guide apparatus is distinguished by the fact that the height-adjusting device has a first drive and a second drive, which can be actuated independently of each other. The first drive is used to open the guide apparatus, that it to say to enlarge its distance from the feed table in such a way that the accessibility for a machine operator is improved. The advantage here is that a misfed sheet can readily be removed and, for example, the adjustment of at least one front lay, which is used to align the leading edge of the sheet transversely with respect to the sheet transport direction, can readily be performed. The second drive is used for the exact setting of the distance of the guide apparatus or of the guide element in relation to the feed table, so that low-marking onward transport of the sheets can be ensured. The height adjustment of the guide element is preferably carried out steplessly.

In a preferred embodiment of the invention, the first and second drives can be coupled to each other, that is to say, one of the two drives acts on the other drive during the height adjustment of the guide element. The two drives can exhibit some interaction when actuated by one drive, although they are driven independently of each other. In other words, the drives which respectively have at least one moving actuating device for displacing the guide element act together in such a way that, during the displacement of the actuating device of the one drive, the actuating device of the other drive is also displaced by the actuating device of the one drive.

In an advantageous exemplary embodiment of the guide apparatus, the first drive is formed by a piston/cylinder unit, which in a preferred embodiment can be actuated pneumatically. Using the piston/cylinder unit, the guide element can be displaced in a straightforward way into at least two positions at a distance from the feed table. Of course, the guide element can also be displaced by the piston/cylinder unit into more than two defined positions at a distance above the feed table, for example by a motor-adjustable stop.

A further exemplary embodiment of the guide apparatus is distinguished by the fact that the second drive has an actuating motor with the aid of which a stepless, preferably precise change in the distance of the guide element with respect to the feed table can be implemented. In a preferred embodiment, with the aid of the actuating motor, an actuating element interacting with the second end of a piston rod of the piston/cylinder unit that forms the first drive can be displaced in the direction of the longitudinal mid-axis of the piston rod. The change in the vertical distance of the guide element in relation to the feed table is carried out, when the second drive is activated, in such a way that both the actuating element of the second drive and the actuating element of the first drive, namely the piston rod, are displaced, without the first drive being activated for this purpose. On the basis of this coupling of the two drives to each other, a modular configuration of the height-adjusting device can be implemented.

In a further exemplary embodiment of the guide apparatus, a foreign-body protective apparatus is provided which, in order to enlarge the distance between the guide element and the feed table, activates at least one of the drives of the height-adjusting device. The first drive, which can open the guide apparatus, is preferably activated, so that damage to the guide apparatus or to the front lay caused by a foreign body can reliably be prevented. When the guide apparatus is opened, the machine is preferably switched off, and this can already be done before the guide apparatus has been opened completely. On the basis of this configuration, a machine guard is also provided at the same time by the foreign-body protective apparatus.

In a preferred embodiment, the foreign-body protective apparatus is configured in such a way that when a force is exceeded which is directed away from the feed table in the vertical direction and acts on a guide which bears the guide element, the drive is activated. This is carried out, for example, when forces greater than 50 N act on the foreign-body protective apparatus or on the guide apparatus.

According to a development of the invention, provision is made for the guide element to be disposed on a cross member which is connected to the guide and can be pivoted about an axis running transversely with respect to the sheet transport direction. The guide element, which is formed for example by a freely rotatable separating roller, is moved in the direction of the front lay or away from the front lay when the crossmember is pivoted. The distance between the guide element and the front lay can therefore be set. The action of pivoting the crossmember can be carried out by at least one lifting device fitted to the guide, such as a piston/cylinder unit, so that the distance between the guide element and the front lay can be set automatically. On the basis of the ability of the guide element to be displaced in the sheet transport direction, the guide element can advantageously be displaced very close to the at least one front lay or front top lay as a first sheet in an imbricated formation, that is to say a stream of sheets, runs in. As a result, particularly reliable feeding or threading of the stream of sheets can be implemented. For the following sheets, the guide element is displaced counter to the sheet transport direction, so that the separating angle for stiff printing materials can be reduced, in order to prevent marking.

In accordance with an added feature of the invention, a guide can be displaced in a vertical direction by the height adjusting device and has racks, including a first rack and a second rack, disposed on a drive and operator side of the sheet-processing machine and on which the cross-member is to be pivotably mounted.

In accordance with an additional feature of the invention, a rotatable geared shaft is disposed in a fixed location, and the racks mesh with the rotatable geared shaft.

In accordance with another feature of the invention, a third rack is coupled to the guide and connected to the piston rod.

In accordance with a further feature of the invention, the guide element is clamped to the cross-member, and a distance between the guide element and a longitudinal mid-axis of the cross-member can be set.

In accordance with another added feature of the invention, the guide element is one of a number of guide elements disposed at a distance from one another and fixed to the cross-member, and it being possible to set a distance from the longitudinal mid-axis of the cross-member individually.

In accordance with another additional feature of the invention, the guide element is a separating roller having a convex configuration.

In accordance with a further added feature of the invention, the cross-member is a front lay guard.

In accordance with a further additional feature of the invention, a vertically adjustable brush is disposed on the front lay guard.

The guide apparatus has at least one guide element which—as viewed in the sheet transport direction—is disposed upstream of at least one front lay. Sheets can be fed to the guide apparatus in underlapped form, that is to say the trailing edge of a preceding sheet overlaps the leading edge of a following sheet. The method is distinguished by the fact that, when the first sheet of a stream of sheets runs in, the guide element—as viewed in the sheet transport direction—is disposed at a short distance from the front lay and that, for the following sheets, the distance between the guide element and the front lay is enlarged. As a result, the secure transportation and feeding into the machine of the first sheet, whose leading edge may be very wavy and can stick upward, is ensured. After the first sheet has passed the guide apparatus, the guide element is displaced counter to the sheet transport direction to such an extent that the separating angle for stiff printing materials can be reduced, in order to prevent marking, and marking-free transportation can be ensured.

In accordance with another feature of the invention, there are the steps of automatically changing the distance between the guide element and the feed table and the distance between the guide element and the front lay.

In accordance with a concomitant feature of the invention, there is the step of setting the distance between the front lay and the guide element steplessly.

Other features which are considered as characteristic for the invention are set forth in the appended claims.

Although the invention is illustrated and described herein as embodied in a guide apparatus for guiding sheets, and a method of operating a guide apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
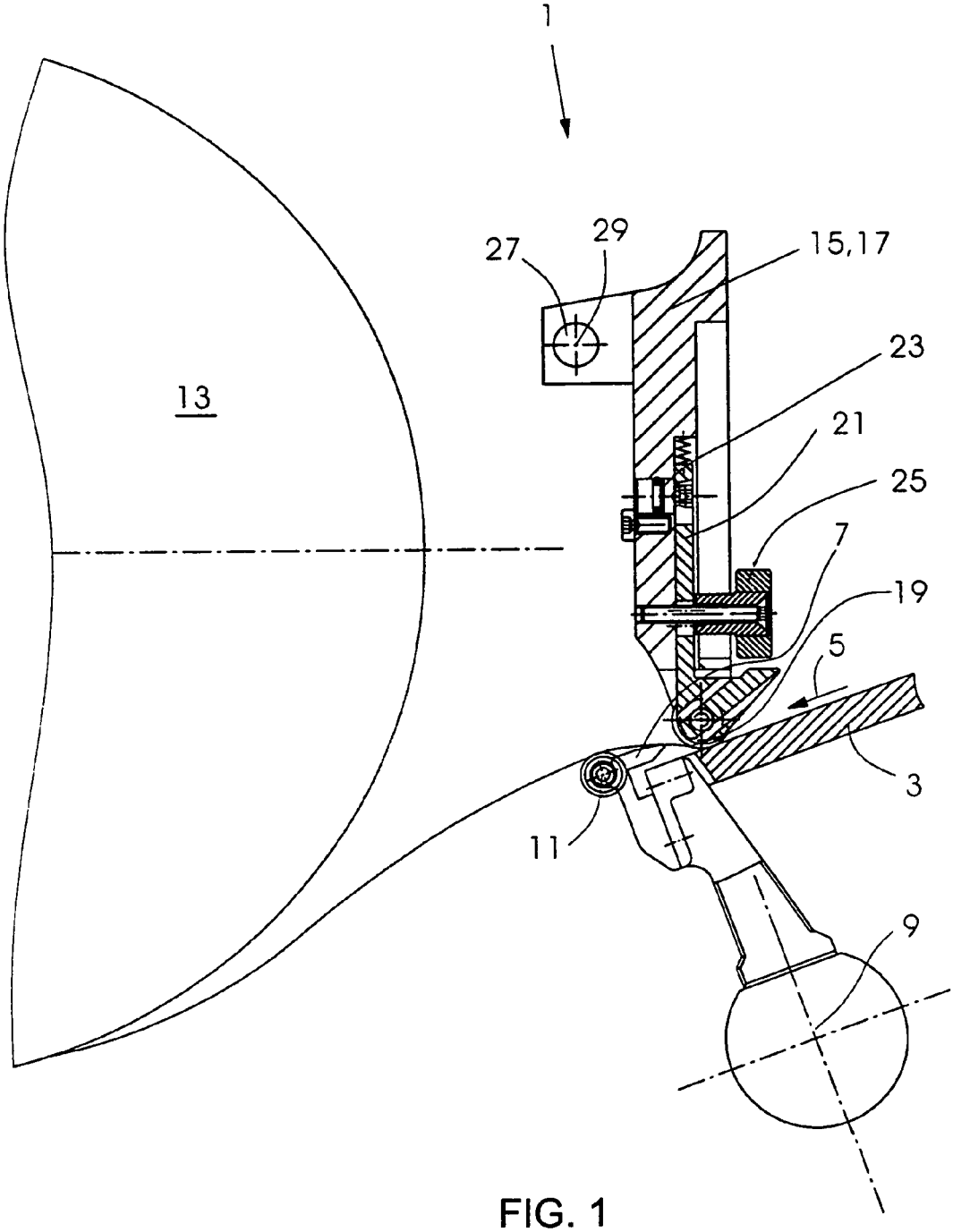
FIG. 1 is a diagrammatic, side-elevational view and sectional view, in parts, of a detail of a first exemplary embodiment of a guide apparatus according to the invention.

In all the figures of the drawing, sub-features and integral parts that correspond to one another bear the same reference symbol in each case. Referring now to the figures of the drawing in detail and first, particularly, to FIG. 1 thereof, there is shown a guide apparatus 1 which can be used generally for guiding sheets, such as paper or board sheets, to a machine, for example a printing machine.

FIG. 1 shows a side view of a part of the machine for processing sheets in a feeder area in which a feed table 3 is disposed, which is used to guide a stream of sheets in an underlapped formation a sheet transport direction 5. The sheets are guided over the feed table 3 against front lays 7 which, in the exemplary embodiment, can be pivoted about an axis 9 running transversely with respect to the sheet transport direction 5. The front top lays 7 are disposed one behind another—as viewed transversely with respect to the sheet transport direction 5—and at a distance from one another. In connection with the present invention, the term "front top lays" is also understood to be front lays.

Provided in the area of the feed table 3 is a non-illustrated side lay, with the aid of which a sheet resting on the front lays 7 can be aligned transversely with respect to the sheet transport direction 5.

Disposed on the front lays 7 are guide rollers 11, which support the sheets on their underside. The sheets, whose leading edge is aligned transversely with respect to the sheet transport direction 5 by the front lays 7, are transported onward at the front lays 7, to a following feed drum 13, by a non-illustrated pregripper.

Disposed above the feed table 3 is the guide apparatus 1, of which only a part is shown in FIG. 1. The guide apparatus 1 contains a crossmember 15 which extends transversely over the feed table 3, and in this exemplary embodiment is configured as a front lay guard 17 and prevents foreign bodies from getting to the front lays 7 or the following part of the machine.

The guide apparatus 1 has a number of guide elements 19, which are disposed one behind another in the lateral direction and at a distance from one another, in such a way that, as viewed in the sheet transport direction 5—they are disposed to align with one of the front lays 7 in each case. The guide elements 19 in the exemplary embodiment are formed by convex separating rollers, which are in each case mounted by ball bearings on a guide element holder 21. In order that the guide elements 19 can be set to the same distance from the feed table 3 during the assembly of the guide apparatus 1, or in each case to a desired distance from the feed table 3, in each case an eccentric 23 is rotatably mounted in the front lay guard 17 and engages in the associated guide element holder 21. The latter is fixed to the front lay guard 17 by a force fit by a clamping device 25 which can be actuated by hand. Each guide element 19 can therefore be released and set off individually, without any tools, via the clamping device 25, that is to say that if it is not needed it can be raised to such an extent and fixed that it does not come into contact with the sheets. When the guide element 19 is set on again, the guide element holder 21 is pressed onto the eccentric 23, and therefore onto the adjusted basic position, by a spring element X.

In the case of severely deformed or very sensitive printing materials, the individual guide elements 19 can be set off without any tools.

Figure 2:
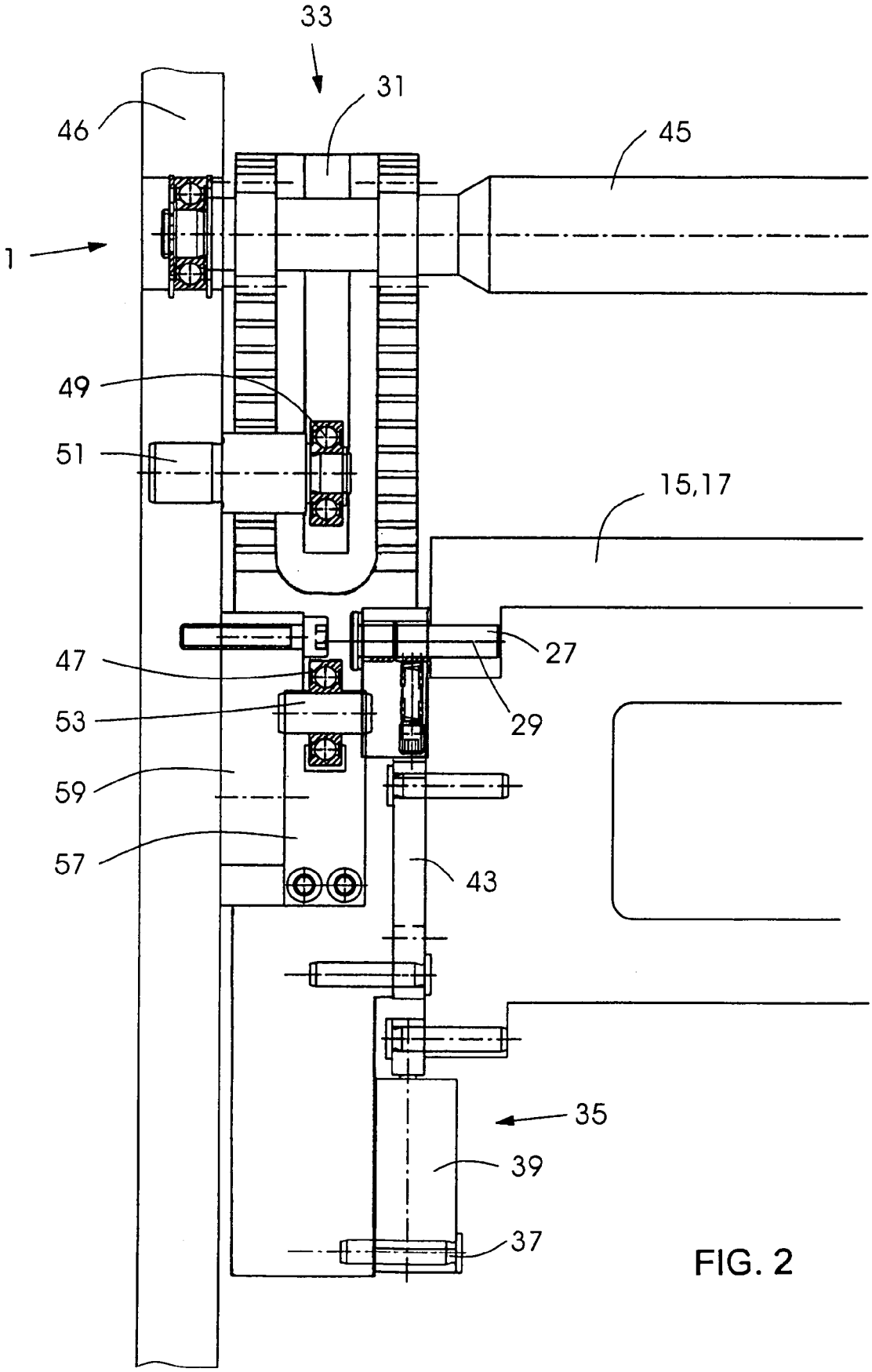
FIG. 2 is a front-elevational view of a detail of the guide apparatus illustrated in FIG. 1, as viewed in a sheet transport direction.

FIG. 2 shows—as viewed in the sheet transport direction 5—a detail from the guide apparatus 1 according to FIG. 1 in the area of a drive side of the machine. Identical parts are provided with the same reference symbols, so that to this extent reference is made to the description relating to FIG. 1. The front lay guard 17, which has a stable profile, is mounted on the drive and operator side of the machine by bolts 27 such that it can be pivoted about an axis 29 running transversely with respect to the sheet transport direction 5, in each case on a rack 31, of which in FIG. 2 only the rack 31 disposed on the drive side can be seen. The racks 31 are part of a guide 33, which are used to open the front lay guard 17 and to set the distance of the guide elements 19 from the feed table 3, and can be displaced in the vertical direction here.

Figure 3:
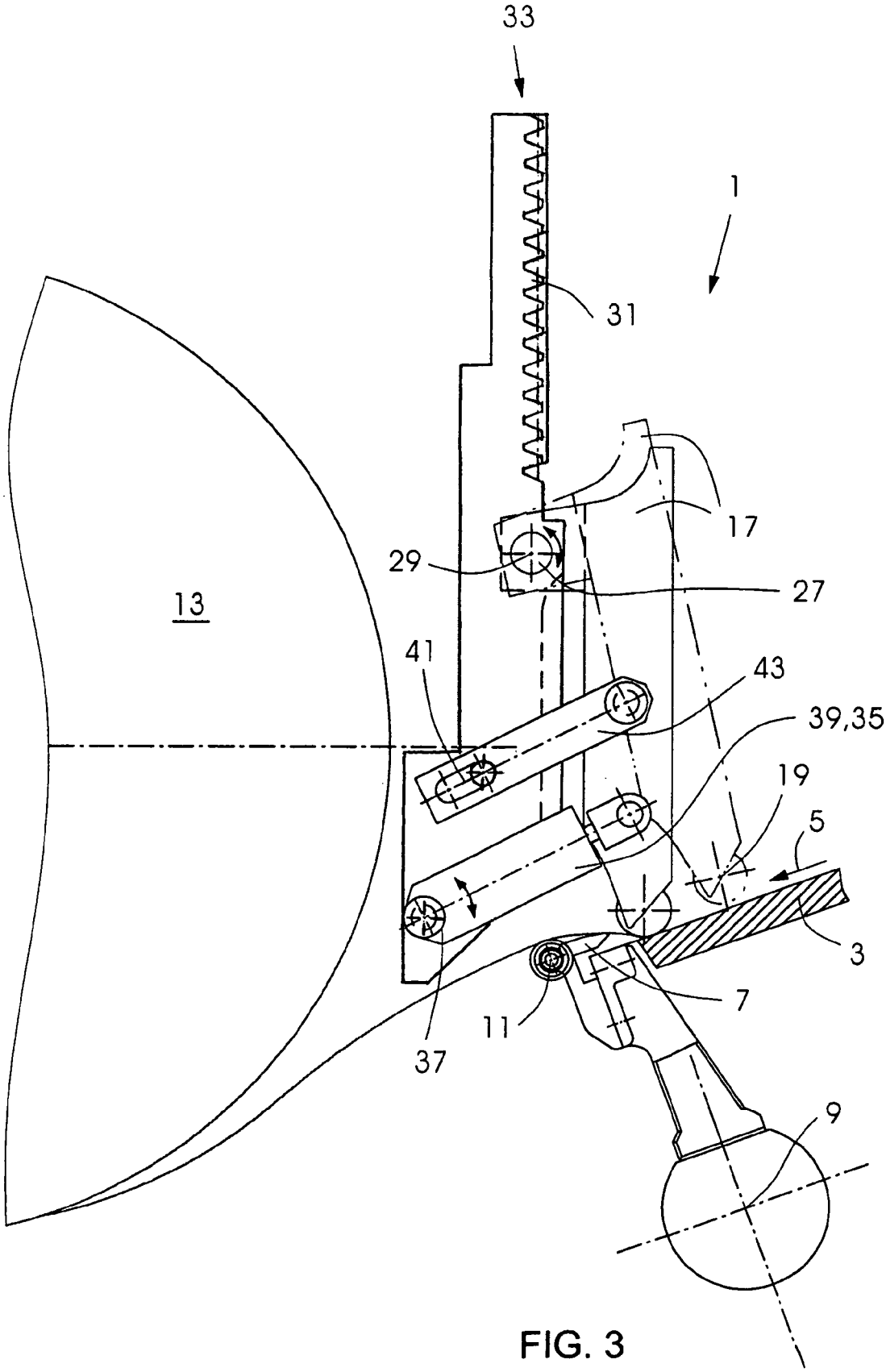
FIGS. 3 and 4 are side views of a further detail of the guide apparatus shown in FIGS. 1 and 2.

As can be seen in FIG. 3, in each case a lifting device 35 is fitted to the racks 31 such that it can be pivoted about an axis 37 running transversely with respect to the sheet transport direction 5. In this exemplary embodiment, the lifting devices 35 are each formed by a pneumatic cylinder 39, which is attached by a hinge in the lower part of the front lay guard 17, close to the guide elements 19.

Mounted on each of the racks 31 is a coupler 43, each of which has a slot 41 and is connected by a hinge to the front lay guard 17. Because of this configuration, the front lay guard 17 with the guide elements 19 disposed on it can be displaced into two defined positions in the sheet transport direction 5. As can be seen from FIG. 3, which shows part of the guide 33 in side view, in a first position of the front lay guard 17, illustrated by a continuous line, the guide elements 19 are disposed at only a very short distance from the front lays 7. The distance between the guide elements 19 and the front lays 7 can be enlarged by the lifting devices 35, which pivot the front lay guard 17 around the axis 29 in such a way that the guide elements 19 are displaced, counter to the sheet transport direction 5, into the position illustrated by a dashed line in FIG. 3. In order that any desired distance can be set between the guide elements 19 and the front lays 7, in an exemplary embodiment which is not illustrated, a motor-adjustable stop is provided instead of the coupler 43.

As can be seen from FIG. 4, which shows part of the guide 33 described with reference to the preceding figures, and from FIG. 2, the racks 31 mesh with a geared shaft 45, which is rotatably mounted in a fixed location in side walls 46 of a machine frame, on the drive side and operator side, and preferably leads through the side wall 46 (FIG. 2) on the operator side. There, a third rack 44, which runs parallel to the racks 31 and can be seen in FIG. 5, meshes with the geared shaft 45 on the outside.

Figure 4:
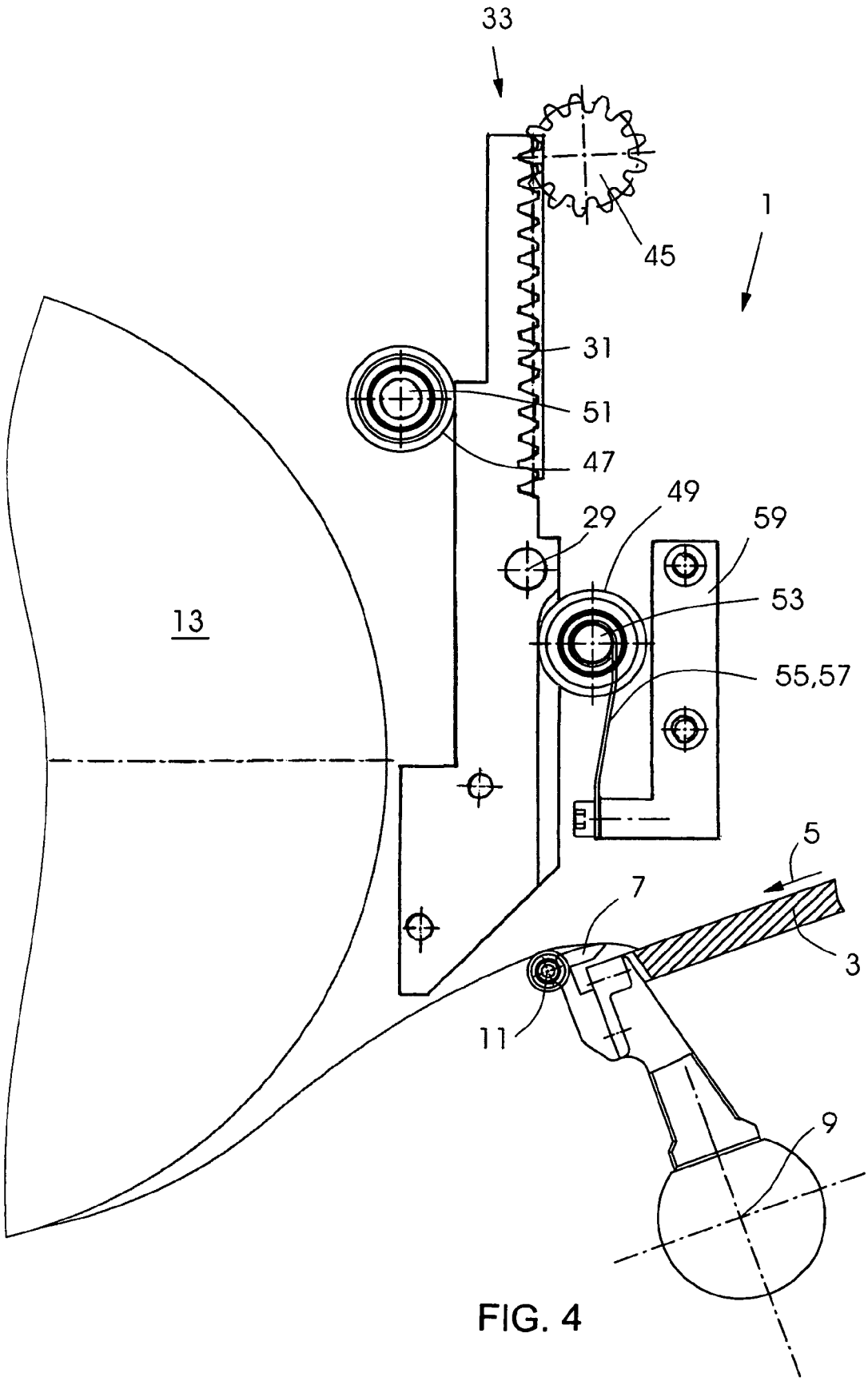

As can be seen from FIG. 4, all three racks 31, 44 are guided by cam rollers 47 and 49, which are disposed on opposite sides of the racks 31, 44 and at a vertical distance from each other. The cam roller 47 is mounted by a bolt 51 fitted to the machine frame (side wall 46, FIG. 2). The other cam roller 49, which is seated on a bolt 53, is pressed resiliently against the racks 31, 44 by a spring element 57, which is formed here by a leaf spring 55, is fitted to a fixed abutment 59 fixed to the frame and acts on the bolt 53, as a result of which the teeth of the racks 31 and those of the third rack 44 are pressed into the teeth of the geared shaft 45. This provides play-free guidance.

Figure 5:
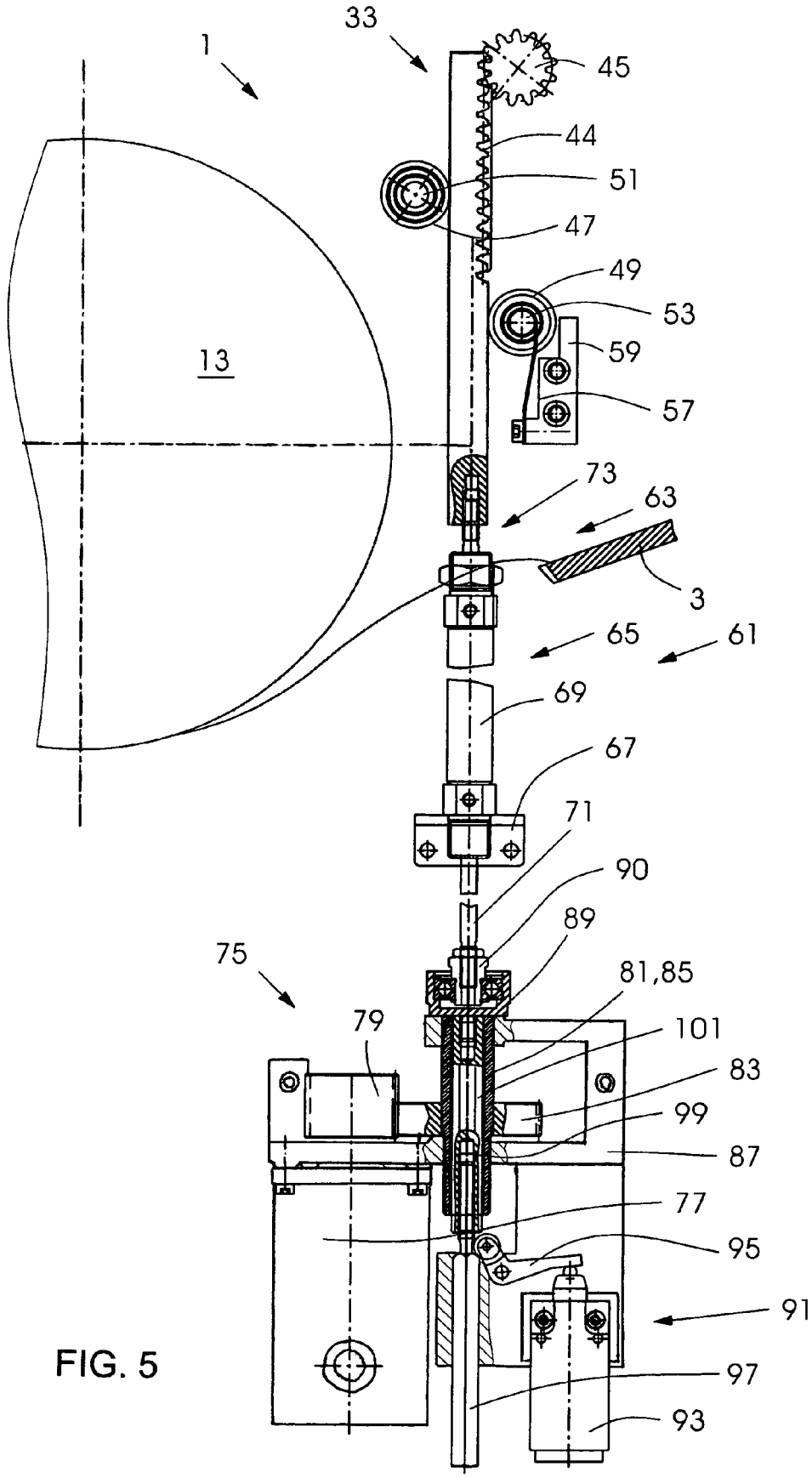
FIG. 5 is a side view and partially a sectional view of a detail of an exemplary embodiment of a height-adjusting device for the guide apparatus.

In addition, the guide apparatus 1 has a height-adjusting device 61, of which one exemplary embodiment is illustrated in FIG. 5. The height-adjusting device 61 is used to change the distance between the guide elements 19 and the feed table 3. For this purpose, the guide 33 having the guide elements 19 is moved, as will be explained in more detail below.

The height-adjusting device 61 contains a first drive 63, which is preferably formed here by a pneumatic piston/cylinder unit 65, which contains a cylinder 69 fitted to an angle 67 fixed to the frame and a piston rod 71 passing through the cylinder. At a first end 73, the piston rod 71 is fixed to the third rack 44. It can be seen from FIG. 5 that the piston rod 71 is essentially disposed so as to align with the third rack 44.

The height-adjusting device 61 also has a second drive 75, which contains an actuating motor 77 which, via a gearbox 79, drives a gear wheel 83 that is connected so as to rotate with an actuating element 81. The actuating element 81 is formed here by a threaded sleeve 85 which has an external thread and is screwed into a threaded hole in a bearing plate 87 disposed fixed to the frame. When the gear wheel 83 is driven, the threaded sleeve 85 is screwed into or out of the bearing plate 87—depending on the direction of rotation of the gear wheel 83—and is therefore displaced vertically upward in the direction of the piston rod 71 or in the opposite direction, that is to say downward. During the displacement of the threaded sleeve 85 in the direction of the piston rod 71 of the first drive 63, the threaded sleeve 85 presses, via a ball-bearing mounted, rotatable bush 89, on a driver 90 that is fitted to the piston rod 71 of the piston/cylinder unit 65, and displaces the piston rod 71 and the third rack 44 upward in the vertical direction. At the same time, the geared shaft 45 in which the third rack 44 engages is rotated. Since the racks 31 of the guide 33 also engage in the geared shaft 45, the two racks 31, and therefore the entire guide 33, on which the front lay guard 17 with the guide elements 19 is disposed, are displaced to a desired guide-element distance from the feed table 3.

With the aid of the actuating motor 75 and the gearbox 79, the distance between the front lay guard 17 and the feed table 3 can be set very precisely and can readily be set optimally to the respective printing-material thickness and stiffness of the sheets, to the sheet format and to the machine speed.

In order to open the front lay guard 17, that is to say to increase the distance between the guide elements 19 and the feed table 3 considerably, the first drive 63 is activated and the piston rod 71 of the pneumatic piston/cylinder unit 65 is extended completely, is therefore displaced as far as possible in the vertical direction, as a result of which the entire guide 33 with the front lay guard 17 and the guide elements 19 rotatably mounted on the latter are lifted away from the feed table 3. As a result of the displacement of the guide 33 with the aid of the first drive 63, good accessibility to the front lays 7 and to the feed cylinder 13 can be produced in a straightforward manner. When the piston rod 71 has been extended completely, the driver 90 is disposed at a distance from the bush 89 or is lifted off the bush 89. The connection between the drives 63 and 75 is therefore uncoupled when the first drive 63 is actuated.

When the guard is opened beyond the operating state (here 20 mm) permitted by the safety regulations, the machine is switched off for the purpose of protecting the personnel, although inching continues to be possible.

It remains to be recorded that the first drive 63 is used only for opening the front lay guard 17, and the second drive 75 for the precise setting of the distance between the front lay guard 17 or the guide element 19 from the feed table 3. In addition, it becomes clear that when the first drive 63 is activated, in the exemplary embodiment illustrated in FIG. 5, the drive is automatically uncoupled from the second drive 75. In an advantageous exemplary embodiment, provision is made for the opening of the front lay guard 17, that is to say the action of spacing the guide 33 away from the feed table 3, to also be possible by the second drive 75 of the height-adjusting device 61, that is to say the threaded bush 85 of the latter can be unscrewed from the bearing plate 87 to such an extent that it is possible to take action in the machine in the area of the guide apparatus 1. As a result, in the event of failure of the first drive 63, it is possible to ensure that the guide apparatus 1 can nevertheless still be opened.

The guide apparatus 1 also has a foreign body protective apparatus 91, which serves the purpose of activating one of the drives 63, 75 of the height-adjusting device 61, the first drive 63 in the exemplary embodiment illustrated in FIG. 5, in order to move the guide apparatus 1 away from the feed table 3. The foreign-body protective apparatus 91 has a single limit switch 93 which is disposed underneath the second drive 75 and which senses the position of a switch rod 97 via a sensing lever 95. The switch rod 97 is screwed into a threaded hole 99 of a connecting element 101 which can be displaced only in the threaded sleeve 85 and is formed here by a hexagonal rod. At its end facing away from the switch rod 97, the connecting element 101 is firmly connected to the piston rod 71.

The function of the foreign-body protective apparatus 91 is now described. If, due to the actuating motor 77, the distance of the front lay guard 17 or the guide element 19 disposed on the latter from the feed table 3 is adjusted, the switch rod 97 is rotated into or out of the threaded hole 99 in the connecting element 101. The switch rod 97 is therefore not displaced in the process. When the front lay guard 17 is opened with the aid of the first drive device 63, the piston rod 71 of the piston/cylinder unit 65 moves upward in the vertical direction and, in so doing, takes the connecting element 101 and the switch rod 97 screwed into the latter with it. As a result, the limit switch 93 is depressed via the sensing lever 95. If, therefore, during continuous operation, a foreign body should get between the front lay guard 17 and the feed table 3 and become jammed in there, as a result of which the guide 33 and therefore also the piston rod 71 were to be lifted in the vertical direction through a preferably only very small distance, then the limit switch 93 would be depressed immediately and the front lay guard 17 would be opened, that is to say the first drive 63 would be activated, so that the guide 33 with the front lay guard 17 disposed on the latter would be moved upward, away from the feed table 3. The limit switch 93 is preferably depressed when the forces acting on the front lay guard 17 are greater than 50 N. When the front lay guard 17 is opened, the machine is preferably switched off.

In an exemplary embodiment of the guide apparatus 1, a non-illustrated adjustable-height brush, for example, is disposed on the front lay guard 17 and reduces the turning up of the trailing edge of the sheet. The trailing edge of the sheet is turned up as a result of the fact that the front lays, as they swing back toward the feed table 3, enter the plane of the sheet and lift the sheet. As a result, thin printing materials in particular are accelerated vertically with respect to the sheet running direction, and a wave which runs through the sheet is produced, as a result of which the end of the sheet which is running out of the guide elements and becoming free flips up. By pressing down the trailing edge of the sheet, the noise at the feeder of the machine can be reduced.

In order to activate the first and second drives 63, 75 and the lifting device 35, in an advantageous exemplary embodiment a switch console is provided at which a machine operator, if required, can adjust the vertical position of the front lay guard 17 or the guide elements 19 with respect to the feed table 3, and also their distance from the front lays 7, manually by pressing a pushbutton. The guide apparatus 1 preferably has no parts that project beyond the feed table 3 in the lateral direction of the machine. As a result, the machine operator can simply remove misfed sheets.

With the aid of the guide apparatus 1 described using the preceding figures, the method mentioned at the beginning can readily be implemented. In a preferred embodiment, this provides that when the printing-material thickness is input, the front lay guard 17 with the guide elements 19 disposed on it is displaced to a short distance, preferably to the shortest distance in the sheet transport direction in relation to the front lays 7 or front top lays for the first sheet of a stream of sheets and, for the second and the following sheets, is displaced—preferably automatically—into the optimum vertical position and—as viewed in the sheet transport direction—to the optimum distance from the front lays 7. In the case of repeated jobs, the position which it is moved to is preferably exactly the same position of the guide elements 19 as in the first print job.

We claim:

1. A guide apparatus for guiding sheets in a transport direction to a sheet-processing machine, including a printing machine, comprising:

a guide element to be disposed above a feed table;

a height-adjusting device connected to said guide element for adjusting a distance between said guide element and the feed table, said height-adjusting device having a first drive and a second drive which can be actuated independently of each other; and a third drive connected to said guide element for pivoting said guide element in and opposite to the sheet transport direction.

2. The guide apparatus according to claim 1, wherein said first drive and said second drive can be coupled to each other.

3. The guide apparatus according to claim 1, wherein said first drive is a piston/cylinder unit.

4. The guide apparatus according to claim 3, including a guide on which said guide element is supported, said piston/cylinder unit having a cylinder disposed in a fixed location and a piston rod which passes through said cylinder, said piston rod having an first end interacting with said guide and a second end.

5. The guide apparatus according to claim 4, wherein said second drive has an actuating element interacting with said second end of said piston rod and an actuating motor interacting with said actuating element for displacing said actuating element in a direction of a longitudinal mid-axis of said piston rod.

6. The guide apparatus according to claim 5, wherein said piston rod and said actuating element are disposed so as to be aligned.

7. The guide apparatus according to claim 4, including a foreign-body protective apparatus which, in order to enlarge said distance between the guide element and the feed table, activates at least one of said first drive and said second drive of said height-adjusting device.

8. The guide apparatus according to claim 7, wherein said foreign-body protective apparatus activates said first driye when a force is exceeded which is directed away from the feed table (3) in a vertical direction and acts on said guide.

9. The guide apparatus according to claim 4, including a cross-member connected to said guide and said guide element is disposed on said cross-member, said cross-member can be pivoted about an axis running transversely with respect to a sheet transport direction.

10. The guide apparatus according to claim 9, wherein said third drive pivots said cross-member.

11. The guide apparatus according to claim 9, wherein said guide can be displaced in a vertical direction by said height adjusting device and has racks, including a first rack and a second rack, disposed on a drive and operator side of the sheet-processing machine and on which said cross-member is to be pivotably mounted.

12. The guide apparatus according to claim 11, including a rotatable geared shaft disposed in a fixed location, and said racks mesh with said rotatable geared shaft.

13. The guide apparatus according to claim 11, including a third rack coupled to said guide and connected to said piston rod.

14. The guide apparatus according to claim 9, wherein said guide element is clamped to said cross-member, and a distance between said guide element and a longitudinal mid-axis of said cross-member can be set.

15. The guide apparatus according to claim 14, wherein said guide element is one of a number of guide elements disposed at a distance from one another and fixed to said cross-member, and it being possible to set a distance from the longitudinal mid-axis of said cross-member individually.

16. The guide apparatus according to claim 1, wherein said guide element is a separating roller having a convex configuration.

17. The guide apparatus according to claim 9, wherein said cross-member is a front lay guard.

18. The guide apparatus according to claim 17, including a vertically adjustable brush disposed on said front lay guard.

19. The guide apparatus according to claim 3, wherein said piston/cylinder unit is a pneumatic piston/cylinder unit.

20. A guide apparatus for guiding sheets in a transport direction to a sheet-processing machine, including a printing machine, comprising:

a guide element to be disposed above a feed table;

a height-adjusting device connected to said guide element for adjusting a distance between said guide element and the feed tables said height-adjusting device having a first vertical drive and a second vertical drive which can be actuated independently of each other; and a third drive connected to said guide element for pivoting said guide element in and opposite to the sheet transport direction.

* * * * *